US005781938A

United States Patent [19]

Anderson

[11] Patent Number: 5,781,938

[45] Date of Patent: Jul. 21, 1998

[54] TOILET SEAT LOWERING DEVICE

[76] Inventor: Eric A. Anderson, 530 Wintersweet Ct., Annapolis, Md. 21401

[21] Appl. No.: 784,396

[22] Filed: Jan. 17, 1997

[51] Int. Cl.[6] ..... A47K 13/10

[52] U.S. Cl. ..... 4/246.1; 4/246.2; 4/241

[58] Field of Search ..... 4/246, 1, 246.2, 4/241, 250, 405, 412, 413, 414, 391, 395

[56] References Cited

U.S. PATENT DOCUMENTS

| | | | |
|---|---|---|---|
| 4,433,442 | 2/1984 | Liou . | |
| 4,551,866 | 11/1985 | Hibbs . | |
| 4,577,350 | 3/1986 | Clark . | |
| 5,020,165 | 6/1991 | Huang | 4/241 |
| 5,222,260 | 6/1993 | Piper . | |
| 5,289,593 | 3/1994 | Lawrence . | |
| 5,307,524 | 5/1994 | Veal . | |
| 5,369,814 | 12/1994 | Denys . | |
| 5,488,744 | 2/1996 | Paananen . | |
| 5,504,947 | 4/1996 | Robello et al. . | |
| 5,570,478 | 11/1996 | Armstrong . | |

FOREIGN PATENT DOCUMENTS

| | | |
|---|---|---|
| 256619 | 7/1927 | United Kingdom . |
| 540794 | 10/1941 | United Kingdom . |
| 90-06715 | 6/1990 | WIPO . |

*Primary Examiner*—Charles R. Eloshway
*Attorney, Agent, or Firm*—Richard C. Litman

[57] ABSTRACT

A toilet seat lowering device provides for the automatic lowering of the seat of a toilet when the toilet has been flushed. A counterbalance arm extends generally rearwardly from the seat, and is offset to one side to clear the tank support and structure behind the bowl. The seat is substantially balanced by the arm, with the arm allowing the seat to lower slowly and gently to a lowered position, resting upon the rim of the bowl. The seat and arm are actuated by an actuating line which is removably connected to a float within the tank. The float may be a conventional tank float, or may be a specially adapted float installed within the tank in addition to the conventional tank float. When the float descends as the water level in the tank drops when the toilet is flushed, the actuating line is drawn downwardly by the descending float, thereby drawing the counterbalance arm upwardly to cause the seat to lower. The actuating line is preferably removably attached to the float by a magnet, thereby allowing the seat to be raised immediately after flushing when the water level within the tank is still low. The magnet causes the line to reconnect to the float automatically when the water level raises the float to its standard position. A second counterbalance arm and actuating line may be used to cause the toilet lid or cover to lower automatically, in addition to the seat, if desired.

18 Claims, 5 Drawing Sheets

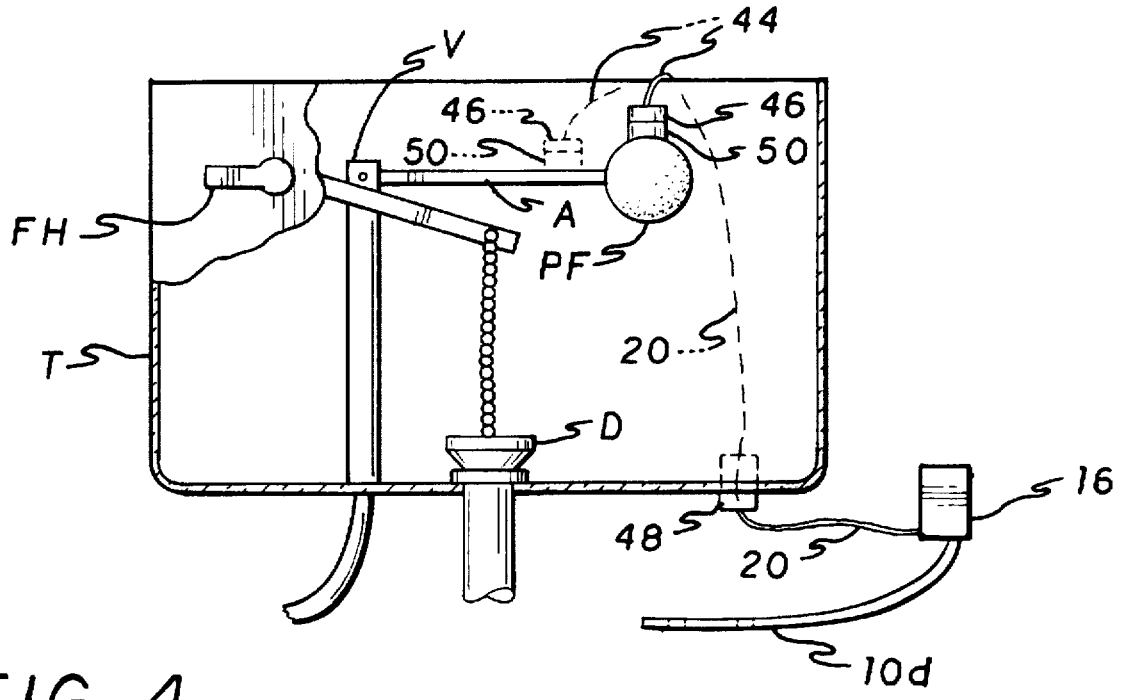
FIG. 4
FIG. 5
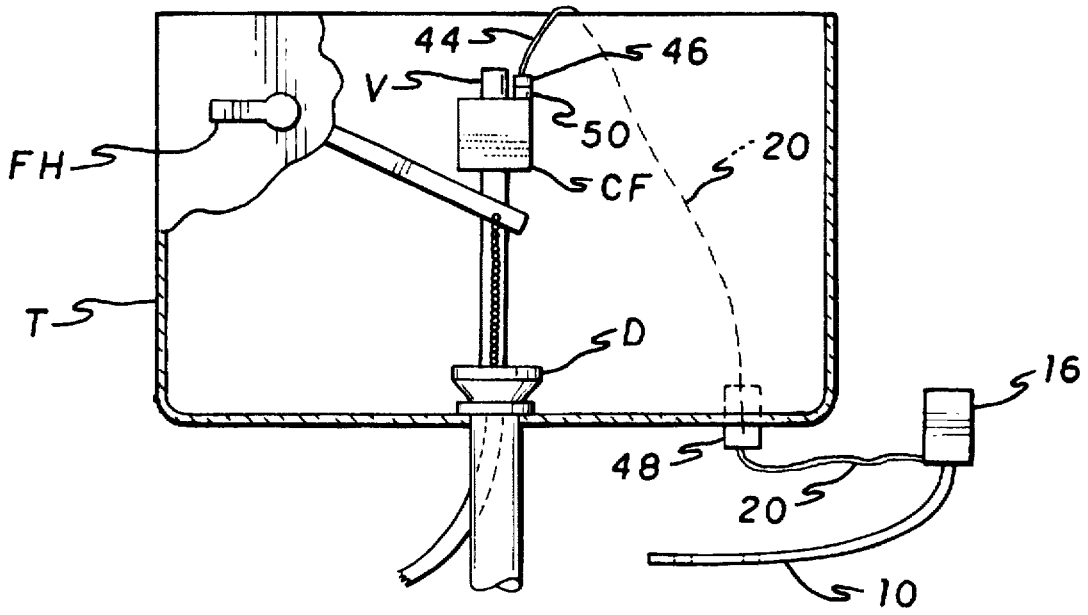

TOILET SEAT LOWERING DEVICE

BACKGROUND OF THE INVENTION

1. Field of the Invention

The present invention relates generally to toilets, water closets, and similar sanitary plumbing fixtures, and more specifically to a device serving to lower the raised seat of a toilet automatically when the toilet is flushed. The device may also be adapted to lower the lid of the toilet in addition to the seat, to cover the toilet bowl completely.

2. Description of the Prior Art

Since the development of the hinged toilet seat, a relatively minor skirmish in the battle of the sexes has been waged over the issue of whether or not the seat (and in some cases, the lid also) should be left in its lowered position after use. Many men leave the seat up after urination, as this is their normal and customary way of using the toilet for such purpose. Women, however, universally use the toilet with the seat in its lowered position, and have come to expect to find the seat, if not the lid also, in the lowered position when they enter the bathroom. Many a man has found it necessary to revise his habits relating to such when living with a woman in the same household, and the habit is not an easy one for men to revise in many cases, even with numerous reminders from the distaff side of the household.

Accordingly, a need will be seen for a device which automatically lowers the hinged seat of a toilet after the toilet is flushed, in accordance with the lowering of the water level in the toilet tank. The device may also be used to lower the lid of the toilet above the seat, if desired. Various devices adapted to perform this function have been developed in the past, and a discussion of those known to the present inventor, and their differences and distinctions from the present invention, is provided below.

U.S. Pat. No. 4,433,442 issued on Feb. 28, 1984 to Shu L. Liou describes a Toilet Seat And Cover Operating Device, comprising a relatively complex assembly of dual floats, seat and lid actuating levers, and float retaining levers within the tank. The apparatus serves to capture the two floats at their lowermost position when the water is drained from the tank during flushing of the toilet, and holds the two floats in a submerged state as the water rises in the tank. The two floats of the Liou patent are in addition to the conventional float which shuts off the water to the tank when it is full, as Liou provides no means for his floats to rise to close the shutoff valve as the tank is filled. Liou requires that a specific lever be operated to first release one of the submerged floats to raise the lid, another lever operated to raise the seat (if desired), and yet another lever be operated to flush the toilet. None of these levers are conventional, as the conventional levers are attached to the seat and lid operating arms outside the tank.

U.S. Pat. No. 4,551,866 issued on Nov. 12, 1985 to Walter G. Hibbs describes an Automatic Toilet Seat Lowering Apparatus, comprising a damping device (shock absorber) secured to a link which is in turn secured to the toilet seat. The damper has very low compressive resistance, allowing the seat to be raised relatively rapidly, with relatively high resistance in the opposite direction to hold the seat in at least a partially raised position for the time required. A spring within the damper urges the seat toward the closed position. The device is not dependent upon the flushing action, as is the present seat lowering device, and cannot act rapidly to accommodate a second person who wishes to use the toilet immediately following a previous user who raised the seat.

U.S. Pat. No. 4,577,350 issued on Mar. 25, 1986 to Emmett T. Clark describes a Device To Automatically Lower A Lifted Toilet Seat, comprising a resilient pneumatic bulb which is suspended along the front of the toilet tank. The bulb is easily compressed when the toilet lid (or lid and seat) is raised against the front of the tank. A check valve allows the resilient bulb to inflate slowly after it is compressed. Clark describes his device as being "a training or reminder device" (column 2, lines 40–41), due to the loud "thud or thump" (column 2, line 41) which will occur if the lid (or lid and seat) are left in their upright position after use and are then allowed to free fall to the close position. The present device is not at all merely a reminder or training device, but rather a fully automatic device which gently lowers the seat and lid of the toilet with no action required other than flushing.

U.S. Pat. No. 5,222,260 issued on Jun. 29, 1993 to Dean E. Piper describes a Toilet Cover Closure Device, comprising a device which secures to the front of the toilet tank to push the lid (or lid and seat) forwardly when the toilet is flushed. One embodiment is operated by a float within the tank, as in the case of the present invention. However, Piper must utilize a separate damping device in a specialized lid and seat hinge configuration, in order to lower the seat and lid gently. The present invention connects the seat (or seat and lid) directly to a float within the tank, rather than merely allowing the lid (and seat) to be pushed slightly forward and then relying upon their weight to close them.

U.S. Pat. No. 5,289,593 issued on Mar. 1, 1994 to James C. Lawrence describes an Automatic Closure For Toilet Seat, comprising an internal tank weight (not a float) having "a specific gravity slightly greater than 1" (abstract and other locations in the disclosure). If the weight is near the top of the tank, the weight will fall when the toilet is flushed and the tank water level drops. The weight is connected by a cable to an arm extending from the rear of the toilet seat, which causes the seat to lower as the weight drops. An over center action allows the seat to drop slowly in the last part of its travel. A duplicate system may be provided for the lid. However, Lawrence provides no means enabling the lid and/or seat to be raised immediately after flushing the toilet, with the weight near the bottom of the tank. While lifting the seat (or lid) would raise the weight, the seat (or lid) would immediately drop, due to the unsupported weight in the empty tank.

U.S. Pat. No. 5,307,524 issued on May 3, 1994 to Bennie N. Veal describes an Automatic Toilet Seat Device comprising a reversible electric motor driving the seat to a raised or lowered position as desired, and associated switches and circuitry within and outside the toilet tank. The electrical operation of the device is beyond the scope of the present invention.

U.S. Pat. No. 5,369,814 issued on Dec. 6, 1994 to Joseph H. Denys describes an Automatic Commode Seat Closing System, comprising a pair of hydraulic cylinders. A first cylinder is connected to the water line to the tank, and is actuated when line pressure drops due to the tank being filled after flushing. The second spring loaded pneumatic cylinder serves to support the seat. When the toilet is flushed, the drop in water line pressure causes the first cylinder to trip a locking lever on the shaft of the second cylinder, allowing the cylinder to be slowly retracted by the weight of the seat. No float mechanism or counterpoise is used, as provided in the present invention.

U.S. Pat. No. 5,488,744 issued on Feb. 6, 1996 to Paul A. Paananen describes an Automatic Toilet Seat Actuator, comprising a damper or shock absorber secured to the seat at one end and to the toilet base at the opposite end. An aim extends radially from the damper body, with the arm being connected co the flush lever. When the lever is actuated, the arm is pulled upwardly, causing the damper to tilt forwardly and to draw the seat forward from its raised position. The damper then allows the seat to lower gently. No float mechanism is provided, as in the present invention.

U.S. Pat. No. 5,504,947 issued on Apr. 9, 1996 to Russell J. Robello et al. describes an Automatic Toilet Seat Lowering Apparatus, comprising a pneumatic cylinder that is normally closed by a raised float in the toilet tank when the water level in the tank is high. When the seat is raised, a valve allows air to enter the pneumatic cylinder, whereupon the seat is held in its raised position by the air trapped within the cylinder. When the toilet is flushed, air is permitted to escape slowly from the cylinder to allow the seat to lower slowly. The present invention is devoid of pneumatic components, and operates by float and counterpoise means.

U.S. Pat. No. 5,570,478 issued on Nov. 5, 1996 to Carmon A. Armstrong describes a Toilet Seat Hinge Assembly For Automatically Lowering Toilet Seat After Flushing. The device comprises a relatively complex, battery powered electronic device including a water level sensor within the toilet tank, electrical switches in the seat hinge assembly, and at least one solenoid, as well as at least one spring to resist the downward motion of the seat. The Armstrong device does not use a float and counterpoise principle, as provided in the present invention.

British Patent Publication No. 256,619 accepted on Jul. 28, 1927 to August Haggenmacher describes Improvements In Sanitary Closets, in which an external hydraulic cylinder causes the seat or lid to raise automatically when the toilet is flushed and the cylinder is filled with water. Further manual action is required to lower the seat or lid. The device thus operates oppositely to the operation of the present invention.

British Patent Publication No. 540,794 accepted on Oct. 30, 1941 to Casimir A. Miketta describes Improvements In And Relating To Water Closets, comprising a hydraulic piston system operated from the water line pressure to the toilet. A manual lever must be operated to raise the seat, whereupon water pressure holds the seat up by means of a hydraulic piston pushing a cam connected to the seat. A drop in water pressure when the toilet is flushed, allows the seat to drop back to a lowered position. The present invention utilizes a float and counterpoise system, and does not require any manual disconnection from the system in order to raise the seat at any time.

Finally, PCT Patent Publication No. 90/06715 published on Jun. 28, 1990 to Rainer M. Lutz illustrates a Toilet Seat With Protective Overlay, comprising a relatively complex hydraulic and electronic device actuated by water supply pressure for the toilet. The device provides for the raising of the seat after toilet use, rather than lowering, so the seat may rest against the tank where a fresh protective overlay is automatically applied to the seat. The seat automatically raises when weight is removed therefrom. Thus, the device is essentially opposite the operation of the present invention, and moreover does not use a float and counterpoise principle as is used in the present invention.

None of the above inventions and patents, taken either singly or in combination, is seen to describe the instant invention as claimed.

SUMMARY OF THE INVENTION

By the present invention, a toilet seat lowering device is disclosed. The device comprises a counterbalanced arm extending rearwardly and somewhat laterally from the toilet seat, with an actuating line extending from the counterbalance weight to a float within the tank. The float may be in addition to the conventional tank float, or may comprise the existing conventional tank float. When the toilet is flushed and the water level drops in the tank, the float also drops and draws the actuating line further into the tank, thereby raising the counterbalance arm and lowering the seat. The action is smooth and gentle, due to the counterbalance which precludes the sudden dropping of the seat. The line is removably attached to the float with a magnet, allowing the seat to be raised before the float has risen when the tank has not yet completely filled immediately after flushing the toilet. The lid or cover of the toilet may also be provided with a counterbalance arm and actuating line, removably connected to the same float in the tank.

Accordingly, it is a principal object of the invention to provide an improved toilet seat lowering device which provides for the automatic smooth and gentle lowering of the toilet seat upon flushing of the toilet.

It is another object of the invention to provide an improved toilet seat lowering device which is actuated by float means within the conventional toilet tank.

It is a further object of the invention to provide an improved toilet seat lowering device which includes counterbalance means extending generally rearwardly from the toilet seat, which counterbalance means is connected to the float means within the tank.

An additional object of the invention is to provide an improved toilet seat lowering device which seat counterbalance means and float means are removably connected, thereby allowing the seat to be raised immediately after the toilet has been flushed and before the float has risen to its steady state position.

Still another object of the invention is to provide an improved toilet seat lowering device which may include a second counterbalance arm secured to the lid or cover of the toilet bowl and removably connected to the tank float, thereby providing for the automatic lowering of both seat and lid when the toilet is flushed.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 4 is a front elevation view in section of the toilet tank, showing the removable attachment of the actuating line to a conventional pivot mounted tank float.

FIG. 5 is a front elevation view in section of the toilet tank, showing the removable attachment of the actuating line to a column mounted tank float.

Similar reference characters denote corresponding features consistently throughout the attached drawings.

DETAILED DESCRIPTION OF THE PREFERRED EMBODIMENTS

Figure 1:
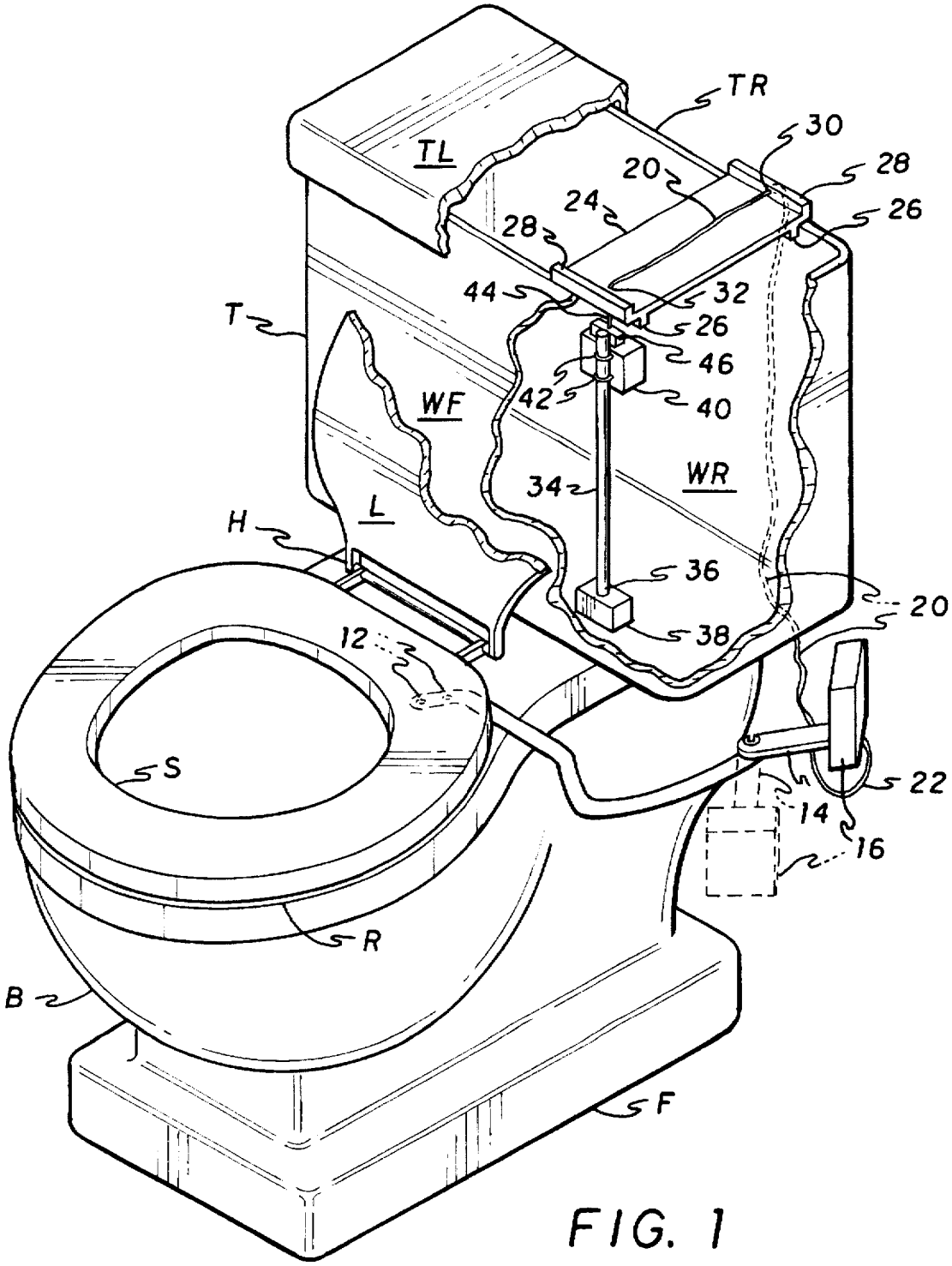
FIG. 1 is a perspective view of a toilet and tank, with the tank partially broken away to show the installation of components of the present toilet seat lifting device therein.

The present invention, an automatic toilet seat lowering mechanism, is shown generally in FIG. 1. The device is installable on a flush toilet F having a toilet bowl B with a rim R, a toilet seat S hingedly attached to the back of the bowl B, and a toilet tank T, with little modification thereto being required.

The seat lowering device includes means for counterbalancing the toilet seat S, to provide for the smooth and gentle lowering of the seat S when the toilet F is flushed. The counterbalance means comprises a seat counterbalance arm 10, which is screwed or otherwise rigidly secured to the seat S as with screws 12 (shown in broken lines) or other suitable means, or integrally formed therewith. Typically, toilet seats S are spaced above the rim R in their lowered position by bumpers or pads P, shown in FIG. 2. These pads P, along with the hinge mechanism H securing the seat S to the bowl B, space the seat S slightly above the rim R, thereby providing sufficient room for the counterbalance arm 10 to extend between the seat S and the bowl rim R when the seat is resting upon the rim R, as shown in broken lines in FIG. 2.

The seat counterbalance arm 10 includes a distal end 14 with a counterbalance weight 16 secured thereto. The distal end 14 may be arcuately movable relative to the arm 10, to position the weight 16 closer to or farther from the seat hinge H in order to adjust the counterbalance moment to balance the weight and moment of the seat S as desired. Alternatively, weight may be added to or removed from the counterbalance weight 16.

Figure 2:
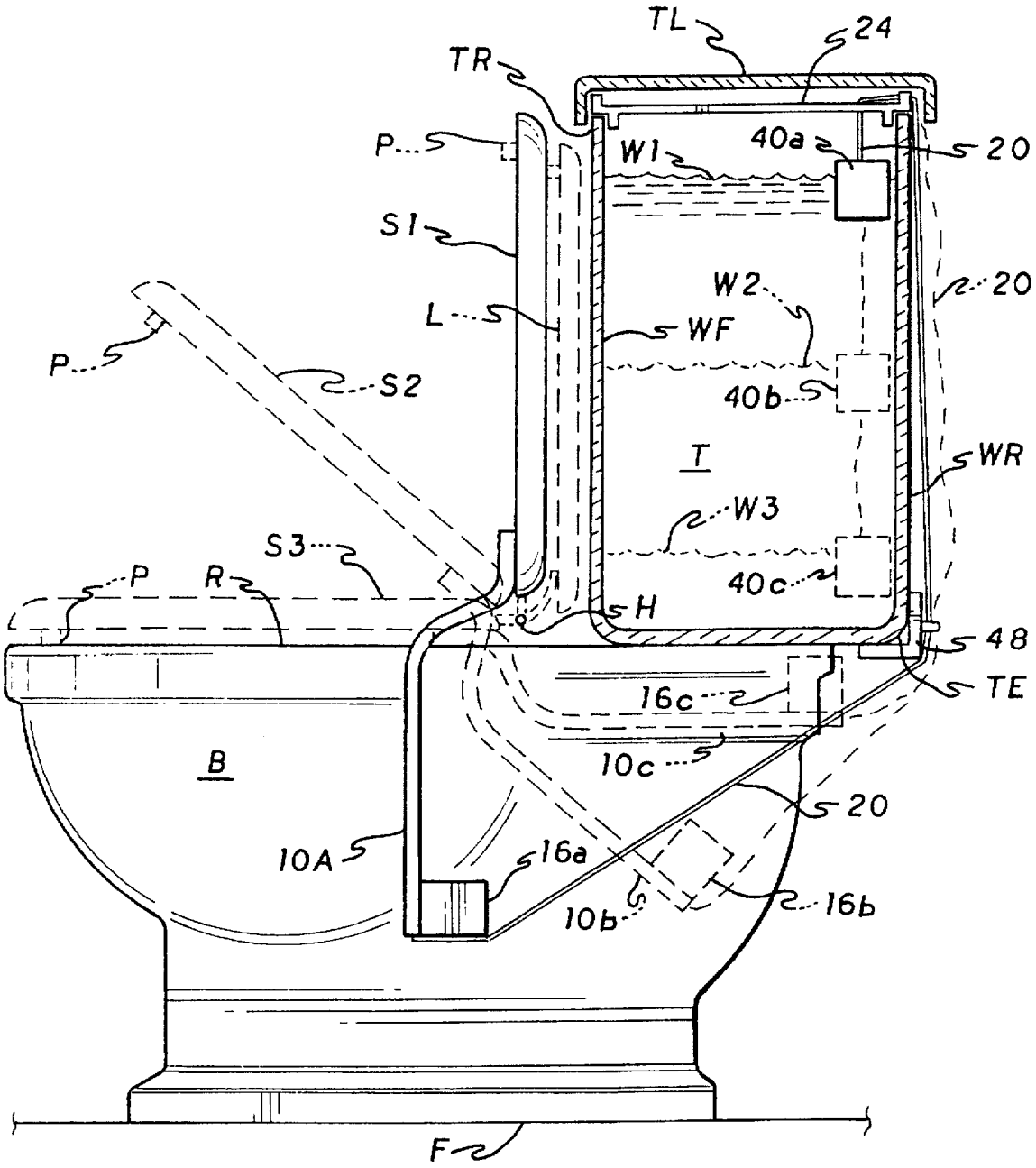
FIG. 2 is a side elevation view of a toilet and tank with the tank shown in section, showing the operation of the seat lowering device at various stages during the flushing operation as the water level in the tank changes.

The counterbalance arm 10 is preferably bent, curved, or otherwise formed to extend slightly below the plane defined by the rim R of the toilet bowl B, so as to provide sufficient room below the bottom of the tank T when the seat S is lowered to a horizontal position to rest upon the rim R, as shown in FIG. 2. The arm 10 is also laterally offset to provide clearance from the rear of the bowl B and its attachment to the tank T, as shown in FIG. 1. The arm 10 may be formed to position the counterbalance weight beside lower portion of the tank T, as shown in FIG. 1, or slightly below the bottom of the tank T, as shown in FIG. 2 of the drawings.

The precise positioning of the counterbalance weight 16 is only critical in that (a) the weight 16 must provide a counterbalancing moment for the great majority of the moment of the seat S, yet not precisely balancing or overbalancing the seat S, in order that the seat S will tend to lower to rest upon the rim R of the bowl B; (b) clearance must be provided for other toilet structure; and (c) the plane of the counterbalance arm 10 must be sufficiently close to the plane of the seat S, to allow the seat S to be raised to a substantially vertical position, closely adjacent to or resting against the front of the toilet tank T or lid L, rather than having a naturally balanced position which would cause the seat S to be only partially raised above the rim R of the bowl B. Otherwise, various shapes and configurations of counterbalance arms may be used as desired, depending upon the configuration of the toilet structure with which they are used.

A seat actuating line 20, formed of a thin, flexible, low friction element such as a plastic monofilament line or other suitable material, has a seat counterbalance attachment end 22 which is secured to the counterbalance weight 16 or to the counterbalance arm 10 near the weight 16. The line 20 passes upwardly in back of the rear wall WR of the toilet tank T, and enters the top of the tank T by means of an internal tank line guide 24, which allows the line 20 to move freely without being pinched by the tank lid TL which rests upon the upper rim TR of the tank T. Preferably, the line guide 24 is formed of a low friction material (e. g., plastic, Nylon; tm, etc.), so the actuating line 20 will slide freely through the inlet and outlet passages 30 and 32.

The line guide 24 comprises a plate which extends across the upper rim TR of the tank T, and is held in place by a pair of downwardly extending flanges 26 which fit immediately within the front and rear walls, respectively WF and WR, of the tank T. The upper surface of the guide 24 includes a pair of spacers 28 extending upwardly therefrom at the opposite ends thereof, to provide space between the upper surface of the guide 24 and the overlying tank lid TL. The line guide 24 includes at least a first or line inlet passage 30 and a second or line outlet passage 32 therein, providing respectively for the entrance of the actuating line 20 into the upper portion of the tank T and across the internal line guide 24 and for the passage of the line 20 downwardly into the tank T.

Alternatively, the line inlet and line outlet guide passage functions may be provided by two separate guide components (not shown), comprising a rearwardly placed line inlet guide and a separate forwardly placed line outlet guide. These two separate components each have a generally U shaped configuration, with the channel of the U serving as a clip which secures over the respective forward or rearward edge of the tank rim TR. The two components each include a flange or other element with a line guide passage therethrough, to provide the required line guide function.

Figure 6:
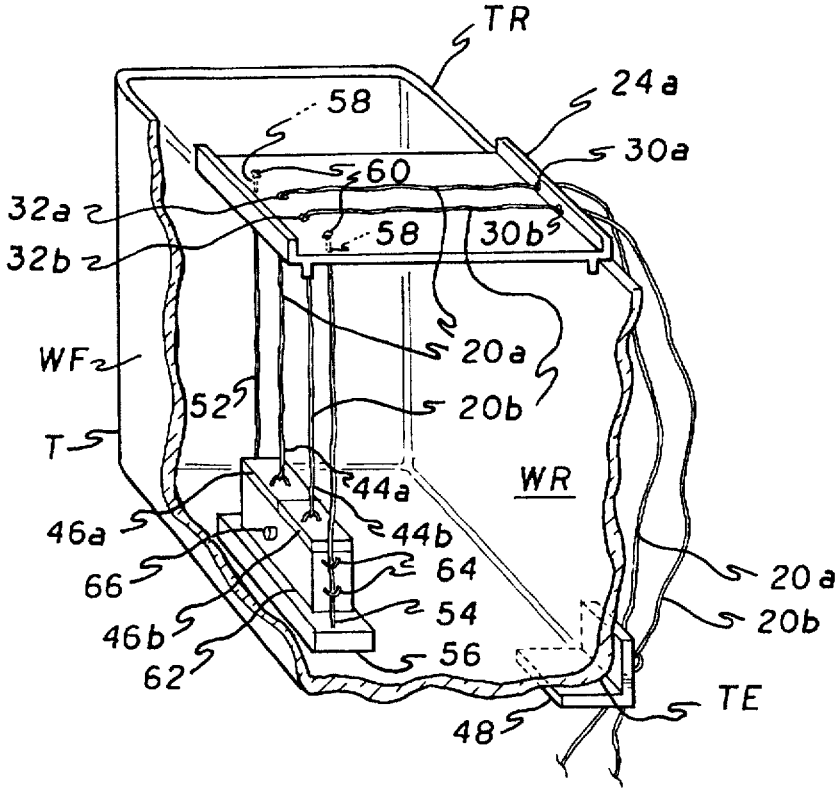
FIG. 6 is a perspective view of a toilet tank, with the tank partially broken away to show details of a double actuating line system serving to close both seat and lid.

The toilet tank T includes some form of float means therein for actuating the lowering of the seat S. This float means may comprise the existing conventional pivotally mounted or column mounted water level float, as shown in FIGS. 5 and 6 and discussed further below, or may comprise a dedicated float, various embodiments of which are shown in the other figures.

In FIG. 1, a float guide rod 34 is positioned within the tank T, adjacent the front wall WF thereof. This guide rod 34 includes a lower end 36 having a ballast weight 38 secured thereto, to hold the guide rod 34 in a substantially vertical position within the tank T. The float means comprises a float 40 slidingly captured on the guide rod 34 by a pair of eyes or loops 42.

A float attachment end 44 of the actuating line 20 is provided opposite the counterbalance attachment end 22 of the line 20. This float attachment end 44 is secured to the float 40 within the tank T, to complete the connection between the toilet seat S and the seat actuating float 40. The float attachment end 44 of the actuating line 20 may be removably secured to the float 40 by some means which allows the float attachment end 44 to reconnect to the float automatically when the float 40 and line attachment end 44 are near one another. Magnetic means 46, shown in greater detail in FIGS. 4 and 5, may be provided for the removable attachment of the guide line float attachment end 44 to the float 40.

The present automatic toilet seat lowering device operates according to the position of the float within the toilet tank T when the toilet F is flushed, and also according to the position of the seat, as shown in FIG. 2 of the drawings. (The float may be positioned at any practicable point within the tank T, and is shown adjacent the rear wall WR of the tank T in FIG. 2.) Ifs the seat has been raised, as shown by the seat position S1 in solid lines in FIG. 2, the seat actuation line 20 will be drawn substantially taut due to the downward and forward movement of the distal end of the counterbalance arm and counterbalance weight, shown in solid lines as counterbalance arm 10*a* and weight 16*a* in FIG. 2.

When the toilet F is flushed, the initial water level W1 will drop in the tank T as it drains into the toilet bowl B to flush the bowl B. As the water level drops, e. g., to an intermediate level W2, the float drops from its initial highest position at 40*a* to an intermediate position 40*b*, thus drawing the seat actuating line 20 downwardly into the tank T and drawing the seat counterbalance arm and weight to an intermediate position 10*b* and 16*b*. The seat is restrained from falling rapidly in its forward and downward movement by the slightly underbalanced counterbalance arm and weight.

As the water level continues to fall to a lowest point W3, the float continues to fall in accordance with the water level to a lowest float point 40*b*. This draws the seat actuation line 20 downwardly into the tank T and thus draws the counterweight arm and weight to a highest position, shown as 10*c* and 16*c*, and the seat to a fully lowered position shown at S3.

Consideration of the above operation will show that due to the slightly underbalanced seat, the seat will remain in its lowered position as the water level rises to refill the tank T after the flushing operation is complete. As the float rises to its uppermost rest position at 40*a* in FIG. 2, the seat actuating line 20 will tend to go slack. A supplemental external line guide 48 is provided at the lower rear edge TE of the tank T, to preclude catching the line 20 around the corner of the tank T as it goes slack. When the tank T is full, the seat S may be raised at any point as desired, e. g. for a male user of the toilet F who wishes to urinate.

Figure 3:
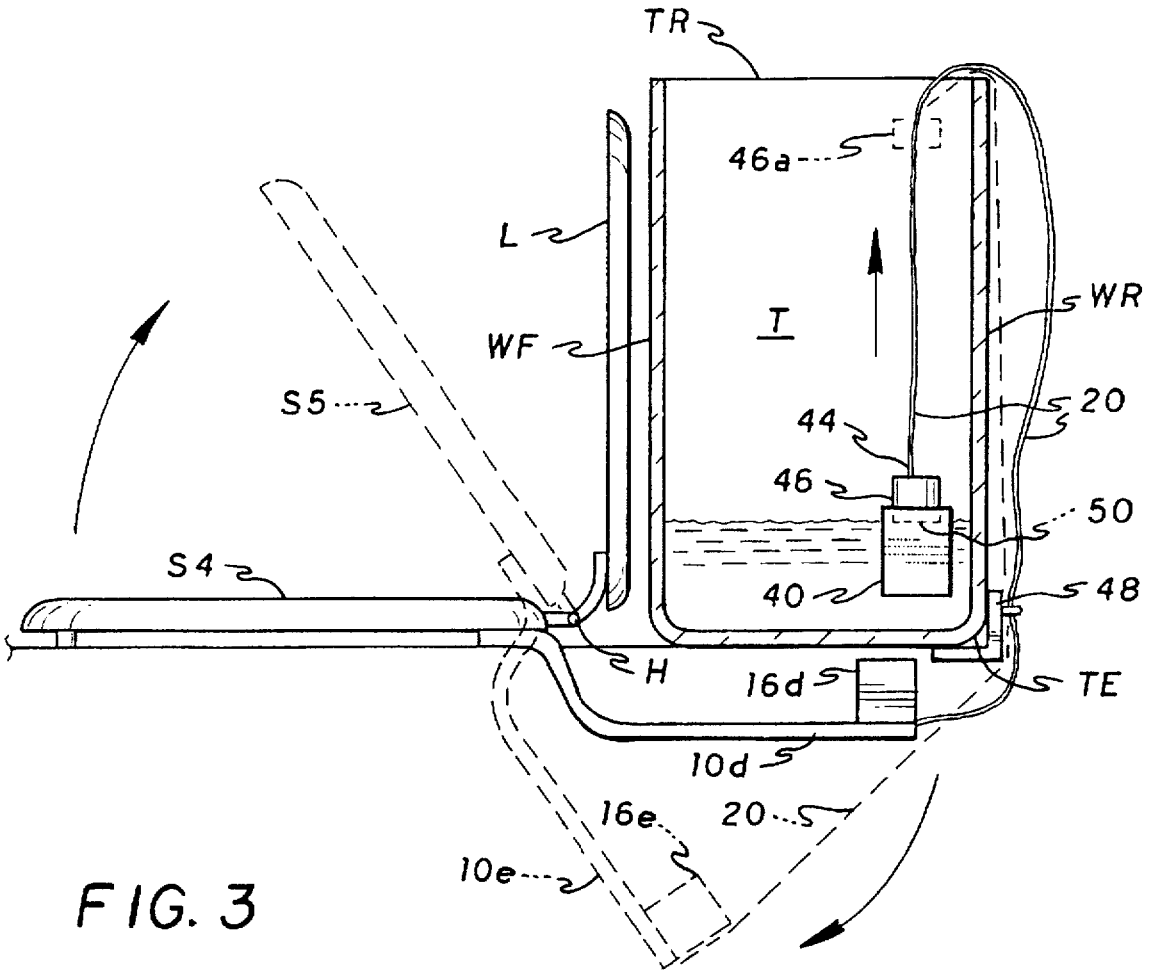
FIG. 3 is a side elevation view of the seat and tank, showing the actuating line being temporarily detached from the float as the seat is raised immediately after flushing.

However, at times it may be desirable that the seat be raised immediately after the toilet has been flushed, before the water level has had time to return to its normal highest level. It will be seen that in such a case, lifting the seat will tend to draw the float upwardly in the tank, suspending it above the lowered water level. The weight of the float, particularly in combination with the seat counterbalance arm and weight, is sufficient to cause the seat to lower to its rest position on the rim of the toilet bowl, unless the seat is held in an upright position. This is an awkward procedure at best, and accordingly the present invention provides means for the seat to be raised immediately after the toilet has been flushed, as shown in FIG. 3. In FIG. 3, the float attachment end 44 of the seat actuating line 20 is permanently secured to a magnet 46, which is in turn magnetically attracted to some suitable magnetic means 50 (ferrous metal, a second magnetically attractive magnet, etc.) which is permanently secured to the top of the float 40. When the seat is raised from its lowered position at S4 to an intermediate position S5 in FIG. 3, the seat actuating line 20 is pulled forwardly and downwardly by the counterbalance arm and weight, shown respectively as 10*d* and 16*d* for the lowered seat position S4 shown in solid lines, and as 10*e* and 16*e* for the intermediate seat position S5 in broken lines. This will be seen to cause the float attachment end 44 of the line 20 to be drawn upwardly within the tank T.

However, with the float attachment end 44 of the line 20 being removably attached to the float 40 by magnetic means 46 and 50, the magnet 46 will separate from the float 40 and rise to the top of the tank T, as indicated by the magnet position 46*a* shown in broken lines. As the mass of the magnet 46 is even less than the combined mass of the magnet and float, there will be insufficient weight on the float attachment end 44 of the line 20 to draw the line 20 downwardly into the tank to lower the seat. Thus, the seat can be raised to a full upright position, as shown in solid lines at position S6 (the corresponding counterbalance arm and weight are not shown for clarity in the drawings), while the tank T is still refilling immediately after a flush. When the water level rises to its highest position, the float 40 will rise to contact the raised magnet 46*a*, automatically reconnecting the line 20 with float 40.

As noted further above, the seat actuating float may be a dedicated float such as the float 40 discussed above, with no additional function. Alternatively, the present invention provides for the use of the existing water level adjusting float universally found within toilet tanks T, as shown in FIGS. 4 and 5.

FIG. 4 discloses a simplified view of the float mechanism utilizing a pivotally mounted float PF. Such a float PF lowers when the water level within the tank T drops, due to the flush handle FH lifting the tank drain valve D, thereby allowing the water within the tank T to drain into the bowl (not shown in FIGS. 4 and 5) for flushing. Water refills the tank T by means of the refill valve V, with the float PF rising until reaching a predetermined position to shut off incoming water at the valve V.

The movement of the pivotal float PF is analogous to the movement of the dedicated float 40 discussed further above, and such a float PF may be used in lieu of a dedicated float in the carrying out of the present invention. The float attachment end 44 of the seat actuating line 20 is permanently secured to a first magnetic means 46, with the attractive second magnetic means 50 permanently secured to the float PF. Alternatively, the second magnetic means 50 may be secured to a point on the arm A of the float PF, as shown in broken lines. (The corresponding line guide position is not shown in FIGS. 4 and 5 for clarity in the drawings.) A column mounted float CF, similar to the float 40 and float guide 34 shown in FIG. 1, is shown in FIG. 5. The operation of such a column mounted float CF is substantially the same as that of the pivotally mounted float PF of FIG. 4, with the float CF dropping as the water level in the tank T lowers during flushing, and then rising again as water enters the tank T through the valve V. The first magnet 46 of the float attachment end 44 of the seat actuating line 20 is positioned to mate with a second magnetic means 50, which is permanently secured to the top of the generally vertically moving column mounted float CF. The basic operation of the system remains essentially as that described above in the discussion of FIG. 4, with a flush handle FH initiating the flushing action, a drain D providing for passage of the water from the tank T into the bowl, and a refill valve V; other components (overflow tube, etc.) are not shown for clarity in the drawings.

FIG. 6 discloses further float guide means, comprising a pair of spaced apart, generally vertical and parallel float guide lines 52, having lower ends 54 secured adjacent the bottom of the tank T by a ballast weight 56 which rests in the bottom of the tank T. The internal tank line guide 24*a* will be seen to be similar to the line guide 24 of FIGS. 1 and 2, but includes line guide attachment passages 58 therethrough, through which the upper ends 60 of the two float guide lines 52 are secured. The float 62 includes eyes 64 at each side thereof, to secure the float 62 slidingly to the float guide lines 52, as the water level in the tank T varies when the toilet is flushed.

Figure 7:
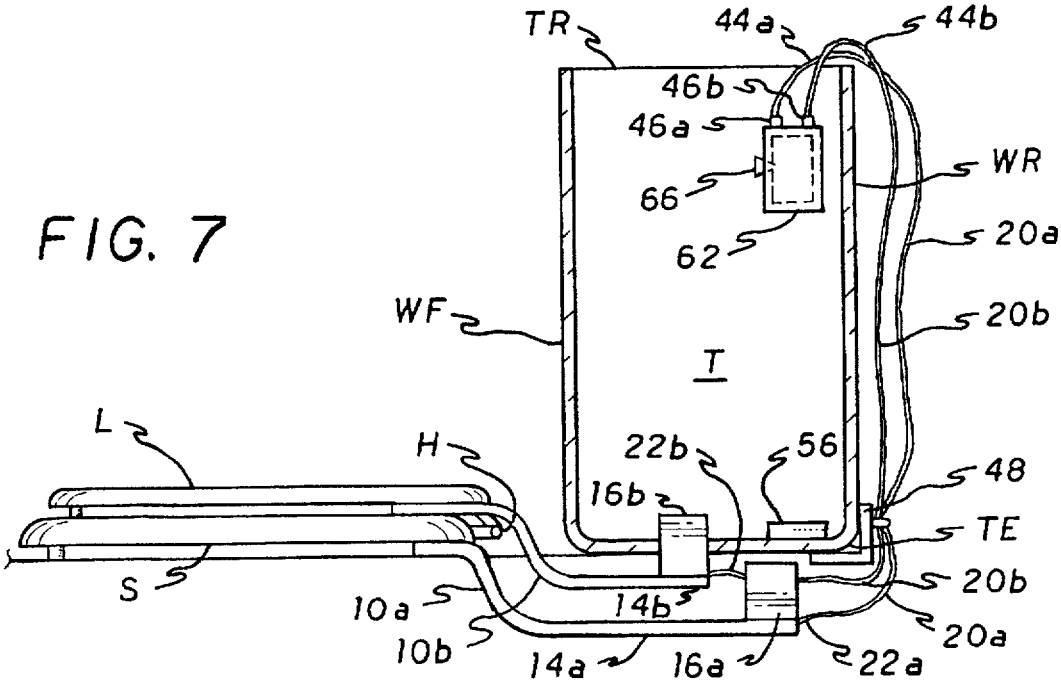
FIG. 7 is a side elevation view of a toilet seat, lid, and tank, with the tank shown in section to disclose further details of the seat and lid closing system.

FIGS. 6 and 7 also disclose a further embodiment of the present invention, in which means are provided to lower the lid L of the toilet automatically, as well as the seat S for a toilet having a lid L and seat S secured to the toilet by a common hinge means H. FIG. 6 discloses the means disposed within the tank T for this function, while FIG. 7 discloses the lid lowering means disposed externally from the tank T.

While only a single float 62 is provided within the tank T of FIGS. 6 and 7, two actuating lines comprising a seat actuating line 20*a* and a lid actuating line 20*b* are provided. These two lines 20*a* and 20*b* extend up the rear wall WR of the tank T, through a pair of inlet line guide passages, respectively 30*a* and 30*b*, and downwardly through a second pair of outlet line guide passages, respectively 32*a* and 32*b*, where their float attachment ends 44*a* and 44*b* are secured to a corresponding pair of magnets, respectively 46*a* and 46*b*, which are removably secured to the top of float 62.

The two lines 20*a* and 20*b* have respective counterbalance attachment ends 22*a* and 22*b* which are secured respectively to a seat counterbalance arm 10*a* and a lid counterbalance arm 10*b*, as shown in FIG. 7. The two counterbalance arms 10*a* and 10*b* each have a configuration similar to the arm 10 discussed further above, and each includes a distal end !4*a*/14*b* with a counterbalance weight thereon, respectively seat counterbalance weight 16*a* and lid counterbalance weight 16*b*. These counterbalance weights 16*a* and 16*b* may be adjustably installed on the ends of their respective counterbalance arms 10*a* and 10*b*, as in the weight 16 of FIG. 1.

The automatic closure of the lid L functions in essentially the same manner as that described further above for the automatic closure of the seat S. When both the seat S and lid L are raised and the toilet is flushed, the water contained within the tank T drains from the tank T into the toilet bowl. The lowering of the water level within the tank T allows the float 62 to drop. The descent of the float 62, either by the guide line means shown in FIG. 6 (not shown in FIG. 7, for clarity in the drawing) or by the guide column means shown in FIG. 1, draws the seat and lid actuation lines 20*a* and 20*b* downwardly into the tank T, thus drawing the respective distal ends 14*a* and 14*b* of the seat counterbalance arm 10*a* and lid counterbalance arm 10*b*, upwardly and rearwardly, respectively causing the seat S and lid L to lower automatically to a rest position on the rim of the toilet bowl.

The float 62 may be made hollow, as shown in FIG. 7, with a removable plug 66 provided to adjust the buoyancy of the float 62 by adjusting the amount of water, if any, contained therein. This provides greater adjustment when the float 62 is required to operate both a seat S and a lid L of a toilet.

The two magnetic means 46*a* and 46*b* respectively allow the seat S and lid L to be raised immediately after the toilet has been flushed while the water level in the tank T is still low, as described in detail further above for the removable attachment of the actuation line 20 from the float 40. (It will be noted that the two magnets 46*a* and 46*b* are shown forwardly and rearwardly of one another in FIG. 7, for clarity in the drawing.)

In summary, the present automatic toilet seat lowering device will be seen to provide a very handy accessory for bathrooms which are shared by both men and women. The present device, in each of its various embodiments, provides a means of quickly, yet smoothly and gently, lowering the raised seat of a toilet automatically immediately after use of the toilet, thus assuring that a male user of the toilet will never again leave the seat in a raised position after use of the toilet. Means have also been described for automatically lowering the lid of the toilet as well as the seat, using only a single float mechanism within the toilet tank to provide an elegant solution to the problem. The present invention is still considerate of the male user of the toilet, in that it allows the seat (and lid, if so equipped) to be raised immediately after the flushing of the toilet, when the water level within the toilet tank is still low, by means of the removably attached and automatically reattached float attachment end(s) of the actuating line(s). This is also desirable for any person who wishes to use the seat, in that the lid may be raised immediately after flushing the toilet by using the above removable float attachment means for the lid actuating line. Thus, the present seat (and lid) lowering device is quite versatile, economical, easily installable with a minimum of modification to the existing toilet and its fixtures, and will prove to be quite reliable in use.

It is to be understood that the present invention is not limited to the sole embodiments described above, but encompasses any and all embodiments within the scope of the following claims.

I claim:

1. A lowering device for a flush toilet seat, with the toilet seat being hingedly installed upon a toilet bowl having a rim therearound and including a toilet tank disposed rearwardly thereon, said device comprising:

a toilet seat counterbalance arm adapted to be rigidly affixed to the toilet seat, with said seat counterbalance arm extending generally rearwardly from the seat and being laterally offset from the seat;

said seat counterbalance arm including a distal end, with said distal end having a seat counterbalance weight secured thereto;

a float adapted to be disposed within the toilet tank, and;

a seat actuating line having a seat counterbalance attachment end and an opposite float attachment end removably secured to said float by magnetic attachment means with said seat actuating line extending between said seat counterbalance arm and said float for drawing said seat counterbalance arm upwardly for lowering the seat when said float descends within the tank as the toilet is flushed.

2. The lowering device according to claim 1, wherein:

said seat counterbalance weight is adjustably secured to said seat counterbalance arm for adjusting of the balance of the assembly comprising the toilet seat, said seat counterbalance arm, and said seat counterbalance weight.

3. The lowering device according to claim 1, including:

a float guide rod adapted to be disposed generally vertically within the tank, with said float guide rod having a lower end with a weight secured thereto for holding said float guide rod within the tank, with said float slidingly secured to said float guide rod and moving vertically thereon as the toilet is flushed.

4. The lowering device according to claim 1, including:

a pair of spaced apart, parallel float guide lines adapted to be disposed generally vertically within the tank, with said float guide lines each having a lower end with a weight secured thereto for holding said float guide lines within the tank and each having an opposite upper end adapted to be secured within the tank, with said float slidingly captured between said float guide lines and moving vertically therealong as the toilet is flushed.

5. The lowering device according to claim 1, wherein:

said magnetic attachment means comprises a first magnet secured to said float attachment end of said seat actuating line and a second magnet secured to said float, with said first magnet and said second magnet being mutually attractive.

6. The lowering device according to claim 1, with the toilet tank further including a front wall, an opposite rear wall, and an upper rim, including:

actuating line guide means adapted to be disposed along the upper rim of the tank at the front wall and the rear wall thereof, with said actuating line guide means including at least two actuating line passages therethrough for guiding said actuating line into the tank and to said float.

7. The lowering device according to claim 1, with the toilet further including a lid hingedly installed upon the toilet bowl, including:

a toilet lid counterbalance arm adapted to be rigidly affixed to the toilet lid, with said lid counterbalance arm extending generally rearwardly from the lid and being laterally offset from the lid;

said lid counterbalance arm including a distal end, with said distal end having a lid counterbalance weight secured thereto, and;

a lid actuating line having a lid counterbalance attachment end and an opposite float attachment end, with said lid actuating line extending between said lid counterbalance arm and said float for drawing said lid counterbalance arm upwardly for lowering the lid when said float descends within the tank as the toilet is flushed.

8. The lowering device according to claim 7, wherein:

said lid counterbalance weight is adjustably secured to said lid counterbalance arm for adjusting of the balance of the assembly comprising the toilet lid, said lid counterbalance arm, and said lid counterbalance weight.

9. The lowering device according to claim 7, wherein:

said float attachment end of said lid actuating line is removably secured to said float by magnetic attachment means.

10. A flush toilet having a toilet bowl with a rim therearound, a seat hingedly installed upon said toilet bowl, a toilet tank disposed rearwardly upon said toilet bowl, and a toilet seat lowering device, comprising in combination:

a toilet seat counterbalance arm rigidly affixed to said seat, with said seat counterbalance arm extending generally rearwardly from said seat and being laterally offset from said seat;

said seat counterbalance arm including a distal end, with said distal end having a seat counterbalance weight secured thereto;

a float disposed within said toilet tank, and;

a seat actuating line having a seat counterbalance attachment end and an opposite float attachment end removably secured to said float by magnetic attachment means, with said seat actuating line extending between said seat counterbalance arm and said float for drawing said seat counterbalance arm upwardly for lowering said seat when said float descends within said tank as said toilet is flushed.

11. The flush toilet and seat lowering device combination according to claim 10, wherein:

said seat counterbalance weight is adjustably secured to said seat counterbalance arm for adjusting of the balance of the assembly comprising said toilet seat, said seat counterbalance arm, and said seat counterbalance weight.

12. The flush toilet and seat lowering device combination according to claim 10, including:

a float guide rod disposed generally vertically within said tank, with said float guide rod having a lower end with a weight secured thereto for holding said float guide rod within said tank, with said float slidingly secured to said float guide rod and moving vertically thereon as said toilet is flushed.

13. The flush toilet and seat lowering device combination according to claim 10, including:

a pair of spaced apart, parallel float guide lines disposed generally vertically within said tank, with said float guide lines each having a lower end with a weight secured thereto for holding said float guide lines within said tank and each having an opposite upper end secured within said tank, with said float slidingly captured between said float guide lines and moving vertically therealong as said toilet is flushed.

14. The flush toilet and seat lowering device combination according to claim 10, wherein:

said magnetic attachment means comprises a first magnet secured to said float attachment end of said seat actuating line and a second magnet secured to said float, with said first magnet and said second magnet being mutually attractive.

15. The flush toilet and seat lowering device combination according to claim 10, with said toilet tank further including a front wall, an opposite rear wall, and an upper rim, including:

actuating line guide means disposed along said upper rim of said tank at said front wall and said rear wall thereof, with said actuating line guide means including at least two actuating line passages therethrough for guiding said actuating line into said tank and to said float.

16. The flush toilet and seat lowering device combination according to claim 10, with said toilet further including a lid hingedly installed upon said toilet bowl, including:

a toilet lid counterbalance arm rigidly affixed to said toilet lid, with said lid counterbalance arm extending generally rearwardly from said lid and being laterally offset from said lid;

said lid counterbalance arm including a distal end, with said distal end having a lid counterbalance weight secured thereto, and;

a lid actuating line having a lid counterbalance attachment end and an opposite float attachment end, with said lid actuating line extending between said lid counterbalance arm and said float for drawing said lid counterbalance arm upwardly for lowering said lid when said float descends within said tank as said toilet is flushed.

17. The flush toilet and seat lowering device combination according to claim 16, wherein:

said lid counterbalance weight is adjustably secured to said lid counterbalance arm for adjusting of the balance of the assembly comprising said toilet lid, said lid counterbalance arm, and said lid counterbalance weight.

18. The flush toilet and seat lowering device combination according to claim 16, wherein:

said float attachment end of said lid actuating line is removably secured to said float by magnetic attachment means.

* * * * *